United States Patent [19]

Frenchik

[11] Patent Number: 4,460,681

[45] Date of Patent: Jul. 17, 1984

[54] IMAGE ENHANCEMENT OF PHOTOTHERMOGRAPHIC ELEMENTS

[75] Inventor: Robert A. Frenchik, Sommerset, Wis.

[73] Assignee: Minnesota Mining and Manufacturing Company, St. Paul, Minn.

[21] Appl. No.: 475,441

[22] Filed: Mar. 15, 1983

[51] Int. Cl.[3] ..... G03C 1/72; G03C 1/46; G03C 1/00

[52] U.S. Cl. ..... 430/502; 430/338; 430/351; 430/353; 430/619

[58] Field of Search ..... 430/351, 353, 338, 502, 430/619

[56] References Cited

U.S. PATENT DOCUMENTS

| | | | |
|---|---|---|---|
| 4,021,240 | 5/1977 | Cerquone et al. | 96/29 D |
| 4,283,477 | 8/1981 | Fletcher et al. | 430/351 |
| 4,368,247 | 1/1983 | Fletcher et al. | 430/17 |

*Primary Examiner*—Mary F. Downey

*Attorney, Agent, or Firm*—Don M. Sell; J. A. Smith; M. A. Litman

[57] ABSTRACT

Color photothermographic articles are prepared by having the various color-forming layers separated by organic solvent soluble barrier layers insoluble in the organic solvent used to coat at least one of the adjacent color-forming layers.

16 Claims, No Drawings

IMAGE ENHANCEMENT OF PHOTOTHERMOGRAPHIC ELEMENTS

TECHNICAL FIELD

The present invention relates to silver halide photothermographic emulsions and in particular to multiple-color image formation in photothermographic emulsions by oxidation of leuco dyes.

BACKGROUND OF THE ART

Silver halide photothermographic imaging materials, often referred to as 'dry silver' compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No., 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver ions which are in catalytic proximity to the specks of the latemt image.

As the visible image is produced entirely by silver, one cannot readily decrease the amount of silver in the emulsion without reducing the available maximum image density. Reduction of the amount of silver is desirable in order to reduce the cost of raw materials used in the emulsion.

One traditional way of attempting to increase the image density of photographic and photothermographic emulsions without increasing or while decreasing the amount of silver in the emulsion layer is by the addition of dye forming materials into the emulsion.

U.S. Pat. No. 4,021,240 discloses the use of sulfonamidophenol reducing agents and four equivalent photographic color couplers in thermographic and photothermographic emulsions to produce dye images including multicolor images.

U.S. Pat. No. 4,022,617 discloses the use of leuco dyes (referred to as leuco base dyes) in photothermographic emulsions. These leuco dyes are oxidized to form a color image during the heat development of the photothermographic element. A number of useful toners and development modifiers are also disclosed.

Various color toning agents which modify the color of the silver image of photothermographic emulsions and darken it to a black or blue-black image are also well known in the art as represented by U.S. Pat. Nos. 4,123,282; 3,994,732; 3,846,136 and 4,021,249.

U.S. Pat. No. 3,985,565 discloses the use of phenolic type photographic color couplers in photothermographic emulsions to provide a color image.

U.S. Pat. No. 3,531,286 discloses the use of photographic phenolic or active methylene color couplers in photothermographic emulsions containing p-phenylenediamine developing agents to produce dye images.

Research Disclosure 17029, "Photothermographic Silver Halide Systems," published June 1978, pp. 9–15, gives a brief history of photothermographic systems and discusses attempts to provide color to them. Many of these previously discussed patents and other art such as U.S. Pat. Nos. 4,022,617; 3,180,731 and 3,761,270 are noted as relevant to the subject of providing dye density and color images to photothermographic emulsions.

One problem which has been encountered in the construction of these systems is the traditional problem of balancing the development rate of the emulsion with the shelf-stability of the emulsion. The more rapidly color may be developed in the emulsion during thermal development, the greater tendency the emulsion has to form dyes without exposure and heating. Classically, whatever one does to speed up the rate of color formation tends to increase the formation of spurious dye images (i.e., background coloration). The use of fast coupling color couplers or easily oxidizable leuco dyes in photothermographic systems consistently tends to increase the amount of spurious dye imaging which occurs. This is analogous to fog in photographic emulsions.

U.S. patent application Ser. No. 271,408, filed June 8, 1981, in the name of Robert A. Frenchik discloses a composition for use in photothermographic emulsions which provides a dye image without increased fog. The composition comprises reduced indoaniline leuco dyes, aromatic carboxylic acid and a p-alkylphenylsulfonic acid in association with the photothermographic silver halide emulsion.

H. G. McGuckin, Research Disclosure No. 13443, issued January 1975, showed color formation by the reaction of leuco base triphenylmethane dyes with silver behenate using development modifiers phthalazinone, phthalimide, and phthalic anhydride. A test for useful leuco dyes was also described.

R. S. Gabrielsen, R. G. Willis, and F. M. Cerquone, Research Disclosure No. 15126, issued November 1976, showed color formation by the reaction of silver behenate with a reducing agent which comprises an azomethine dye or an azo dye in the presence of N-hydroxy-1,8-naphthalimide.

R. G. Willis, Research Disclosure No. 15676, issued April 1977, describes dye enhanced silver images by dye bleach in non-light exposed areas by developing agent which is oxidized by the silver in the light exposed areas. The dye remains unchanged in imaged areas. The use of indoaniline and indophenol dyes was cited as a reducing agent.

F. M. Cerquone, R. S. Gabrielsen and R. H. Willis, U.S. Pat. No. 4,021,240, issued May 3, 1977 show multiple layers in column 22, lines 7 to 65 and column 23, line 1 to 57. Interlayers of polyvinyl alcohol were used to preserve the integrity of the color-forming layers. Other hydrophilic polymers, such as gelatin, were also found useful. The use of other synthetic polymeric binders alone or in combination as vehicles or binding agent and in various layers was described. Useful resins such as poly(vinyl butyral), cellulose acetate butyrate, polymethyl methacrylate, ethyl cellulose, polystyrene, polyvinyl chloride, chlorinated rubber, butadiene-styrene copolymers, vinyl chloride-vinyl acetate copolymers; copolymers of vinyl acetate, vinyl chloride, and maleic acid and poly(vinyl alcohol) were cited.

BRIEF DESCRIPTION OF THE INVENTION

Multicolor photothermographic imaging articles are provided with the various color forming layers (usually sets of bilayers for each color) maintained distinct from each other by the use of functional or non-functional barrier layers between the various photosensitive layers or bilayers. A barrier layer overlaying one photosensitive, photothermographic emulsion layer is insoluble in the solvent of the next photosensitive, photothermographic layer. Photothermographic articles having at least 2 or 3 distinct color image forming layers are disclosed. The barrier layers are "functional" when ingredients active in the formation of color material are included therein. The barrier layers are considered "non-functional" when no ingredients active in the formation of dye images or silver images are included within that layer.

In the present invention a color photothermographic imageable article is shown which comprises a substrate, a first photothermographic emulsion layer, an organic solvent soluble barrier layer, a second photothermographic emulsion layer and a polymeric cover layer. Each of the photothermographic layers comprise a reducible silver source, photosensitive silver halide, a reducing agent for silver ion and solvent soluble binder. Each photothermographic layer is sensitized to a portion of the spectrum at least 60 nm different from the other photothermographic layer, and each photothermographic layer contains a leuco dye which when oxidized forms a visible dye having a maximum absorbance at least 60 nm different from that of the dye formed in the at least one other photosensitive layer. The barrier layer between said photothermographic layers is insoluble in the solvent contained in the second photothermographic layer. The use of the same solvents in photosensitive layers and the covering barrier layer is preferred.

DETAILED DESCRIPTION OF THE INVENTION

Polymers which are insoluble in aqueous systems, soluble in some organic solvents, and impervious to certain other organic solvents, can be utilized as barrier layers in construction of an at least two- and preferably at least three-color photothermographic color recording system. This type of construction with the proper solvent selection is conducive to the use of simultaneous multiple coating techniques with good color separation.

The second part of this invention is a construction which enables the simultaneous thermal development of at least two or at least three individual color forming photothermographic systems having different chemistry, but similar thermal properties.

This technology enables one to construct a three-color photothermographic recording system capable of recording color (electronic) phosphor light output or other color light output and giving a color reproduction within as little as a 10 second development at 255° to 295° F.

The term "organic solvent soluble" used to describe the barrier layers requires that the polymer used as the barrier layer be directly soluble in an organic solvent. This definition clearly excludes such materials as polyvinyl alcohol which, if it is to be dissolved in an alcohol (one of the few organic materials which it can be dissolved in), must first be dissolved in water and heated. Gelatin would also be clearly excluded, but polyvinylpyrrolidone (soluble in either water or organic solvents) would be included. The use of organic solvent soluble barrier layers has numerous improvements over water soluble layers. For example, (a) the organic leuco dyes cannot be dissolved in the barrier layers which is a desirable alternative, (b) polyvinyl alcohol will not wet the other polymer layers and tends to separate, (c) polyvinyl alcohol is not conducive to simultaneous coating with the organic solvent soluble adjacent layers, and (d) water soluble layers tend to absorb moisture which is evaporated during thermal development and can form unsightly spots within or between the layers.

This invention preferably uses a three color system of yellow, magenta and cyan color formation based on the heat induced oxidation/reduction reaction between (a) the light exposed silver halide and silver source (preferably the silver salt of a fatty acid which is in catalytic proximity to silver halide, preferably by halidization, and is dye sensitized to a specific wavelength of radiation) and (b) a chromogenic developer. The yellow color forming system is blue sensitive and is generally coated first out of a solvent. This system consists of two coatings, a silver containing first layer and then a second layer whose polymer is impervious to the solvent in the second color system applied, preferably toluene or toluene and alcohol. The developer preferably can either be a biphenol derivative or a triarylimidazone whose oxidative product is yellow. This system uses a combination of phthalazine or phthalazinone with phthalic acid or one of its derivatives. The second layer "barrier" polymers may, for example, be maleic anhydride/vinyl methyl ether copolymers, polyvinyldiene chloride (saran), or polyvinylpyrrolidone. The preferred polymers are maleic acid copolymers such as alkyl monoesters of poly(methyl vinyl ether/maleic acid).

The magenta color forming system is green sensitive and is usually coated second out of a different solvent system than the first two layers and which is not able to penetrate the first barrier layer (e.g., a solvent such as 90% toluene and 10% ethanol is used). This also consists of two coatings, the first being the silver and the second layer containing a polymer which is impervious to the solvent of the third color system applied, preferably alcohol. The developer is preferably a leuco indoaniline dye whose oxidative product is magenta. This system preferably uses a toner combination of phthalazine, phthalic acid or its derivatives, and tetrachlorophthalic acid. Phthalazinone can be used in place of or in addition to phthalazine which can also be used alone.

The "barrier" polymer, which is the fourth layer and preferably contains the color reactants, is normally a methyl methacrylate polymer (preferably a hard polymer with a Tukon hardness of 20 or more), copolymer, or blend with other polymers or copolymers (e.g., copolymers with n-butylacrylate, butylmethacrylate, and other acrylates such as acrylic acid, methacrylic acid, acrylic anhdride, and the like), polystyrene, or a combination of a polyvinyl chloride tripolymer with a butadiene-styrene copolymer. The preferred polymer is a hard methyl methacrylate homopolymer (i.e., having a Tukon hardness greater than 20 e.g., Acryloid A21 with a Tukon hardness of 21–22) blended with soft methylmethacrylate copolymers (i.e., having a Tukon hardness of less than 20, e.g., Acryloid B-66 with a Tukon hardness of less than 18). The barrier layer may be crosslinked also. This would be preferably done by the inclusion of a latent or activateable crosslinking agent. Crosslinking could then be effected after coating.

The cyan color forming system also consists of two coatings. The first being a red sensitive silver layer and the second is also the last coating and is considered the topcoat which requires an alcohol soluble polymer with a high softening temperature (i.e., greater than 255° F. and up to or greater than 295° F.). This system is, for example, coated out of 90% alcohol/10% toluene or 100% alcohol. The color former is a leuco indoaniline dye whose oxidative product is blue.

This color former material is combined with oxidized ascorbic acid, phthalazine, phthalic acid or its derivatives, and tetrachlorophthalic acid. These are placed in the topcoat layer.

The six coatings can either be coated as single layers and dried before the next layer in applied or each monocolor can be dual coated; i.e., each of the sensitized silver layers with its respective topcoat barrier resin system can be coated together to reduce the number of passes through the coater. This is a point where aqueous coatings of gelatine and polyvinyl alcohol particularly fail by being incompatible with organic solvent containing coatings.

The preferred photothermagraphic silver containing polymer is polyvinyl butyral, but ethyl cellulose, methacrylate copolymers, maleic anhydride ester copolymers, polystyrene, and butadiene-styrene copolymers, can be used where applicable according to the solvents used.

The test for determining if a barrier polymer is impermeable to the solvent of the next layer can be simply performed. First coat a layer containing a sensitized, halidized silver salt of a fatty carboxylic (e.g., 10–32 carbon atoms, preferably 12–29 carbon atoms) acid and polyvinyl butyral polymer. A second coating of the candidate barrier polymer is applied after the first coating has dried. The last layer contains the appropriate solvent, a color forming developer, and toner reactants. The dried coatings are given an excessive light exposure and then heated for 60 seconds at 255°–280° F. The test is positive if no color or image is formed.

The leuco dyes and dye forming developers used in the present invention may be any colorless or lightly colored compound which forms a visible dye upon oxidation. The compound must be oxidizable to a colored state. Compounds which are both pH sensitive and oxidizable to a colored state are useful but not preferred, while compounds only sensitive to changes in pH are not included within the term "leuco dyes" since they are not oxidizable to a colored form.

The dyes formed from the leuco dyes in the various color-forming layers should of course be different. A difference of at least 60 nm in reflective or transmissive maximum absorbance is required. Preferably the absorbance maximum of dyes formed will differ at least 80 or 100 nm. When three dyes are to be formed, two should differ by at least these minimums, and the third should differ from at least one of the other dyes by at least 150 nm and preferably at least 200 or even at least 250 nm. This will provide a good, full color range for the final image.

Any leuco dye capable of being oxidized by silver ion to form a visible is useful in the present invention as previously noted. Dye forming developers such as those disclosed in U.S. Pat. Nos. 3,445,234; 4,021,250; 4,022,617 and 4,368,247 are useful. In particular, the dyes listed in Japanese Kohyo National Publication No. 500352/82, published Feb. 25, 1982 are preferred. Preferably naphthols and arylmethyl-1-naphthols are preferred. Naphthols and preferred naphthols are described below.

Useful dye forming developers as disclosed in Japanese Kohyo 500352/82 include compounds of the formula:

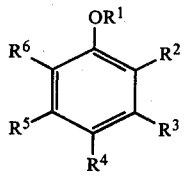

in which $R^1$ represents a hydrogen atom or hydrolysable group, each of $R^2$ to $R^6$ is independently selected from a hydrogen or halogen atom, an alkyl, aryl, alkoxy, aryloxy or amino group each of which groups may be substituted, hydroxy group, a thiol group or a thioether group, or two or more adjacent groups from $R^2$ to $R^6$ may represent the necessary atoms to complete one or more carbocyclic or heterocyclic ring systems.

Naphthols suitable for use as dye-forming developing agents include alkoxy-1-naphthols, dialkylamino-1-naphthols and arylmethyl-1-naphthols.

Alkoxy-1-naphthols and masked naphthols include those of the general formula:

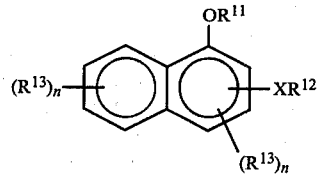

(2)

in which:

X is O, S or Se, $XR^{12}$ can be in the 2 or 4 position, $R^{11}$ is hydrogen or an alkali liable protecting group (i.e., a group which is converted to or replaced by hydrogen at a pH greater than 7.0), e.g. acetyl, chloroacetyl, dichloroacetyl, trichloroacetyl, trifluoroacetyl, carboalkyl, carboaryloxy, carbonate, benzoyl, n-nitrobenzoyl, 3,5-dinitrobenzoyl and 2-benzenesulphonyl-1-ethoxycarbonyl, $R^{12}$ represents a ballast group, e.g., alkyl, alkenyl, alkoxyalkyl, arylalkyl, aryloxyalkyl, alkylarylalkyl, alkylaryloxyalkyl, alkylaryloxyalkyl, amino or dialkylaminoalkyl, trialkylammonium alkyl, acylamidoalkyl, carboxy and sulpho-containing alkyl, ester containing alkyl, these ballast groups are well known to those skilled in the art of silver halide photographic materials, and may contain up to 20 or 30 carbon atoms, each $R^{13}$ independently represents a ring substituent selected among the following groups: hydrogen, alkyl, aryl, hydroxy, alkoxy, aryloxy, amino, alkylamino, dialkylamino, arylamino, diarylamino, carboxy, carboalkoxy, carbonamido (all of which may contain up to 30 carbon atoms, preferably up to 12 carbon atoms), sulfonic acid, sulfonate, aryl-sulfonyl, sulfoalkoxy, sulfonamido, halide, e.g., fluorine, chlorine, bromide, iodine, and n is an integer between 0 and 4.

Dye-forming developers of the amino naphthol type suitable for use in the invention include those of the general formula:

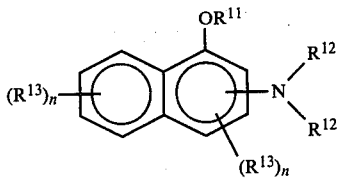

(3)

in which $R^{11}$, $R^{13}$ and n are as defined above in formula (2), the amino group can be either in the 2 or 4 position, and each $R^{12}$ is as defined above in formula (2) or together represent the necessary atoms to form a heterocyclic ring such as 2,5-dialkylpyryl, 2,6-dialkyl-1,4-oxazolyl and 4-oxo-pyridyl.

Dye-forming developers of the alkyl-1-naphthol type include those of the general formula:

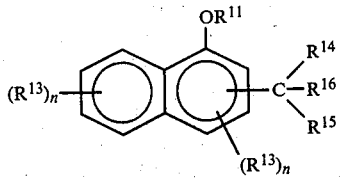

(4)

in which the $CR^{14}R^{15}R^{16}$ group can be in the 2 or 4 position, $R^{11}$, $R^{13}$ and n are as defined above, $R^{14}$ represents alkyl (of up to 20 carbon atoms) or preferably hydrogen, $R^{15}$ is hydrogen, alkyl (of up to 20 carbon atoms) or preferably an aromatic group, e.g. phenyl, p-hydroxyphenyl, p-tolyl, p-anisyl, xylyl, mesityl, p-dialkylaminophenyl, p-biphenyl, 1-naphthyl, 2-naphthyl, 9-anthracenyl and phenanthryl, $R^{16}$ is preferably an aromatic group capable of activating the methine hydrogen of the naphthol developer e.g. aryl, alkylaryl, alkoxyaryl, hydroxyaryl, tropyl, $R^{16}$ together with $R^{15}$ represents the necessary atoms to complete a carbocyclic or heterocyclic ring system which is fused or linked to one or more aromatic rings. Such a $CR^{15}R^{16}$ ring can assume the following general structures: fluorenyl, anthryl, benzanthryl, dibenzosuberyl, tropyl, dibenzotropyl, arylchromyl, arylthiochromyl, chromyl, thiochromyl, 2,3-diaryl-1,4-imidazolyl, and includes:

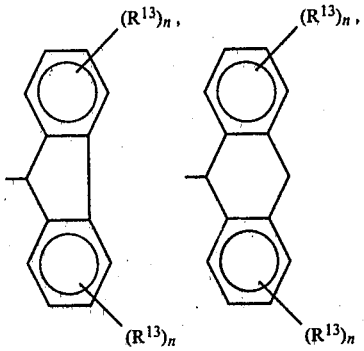

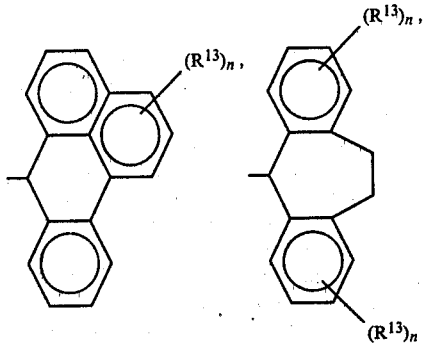

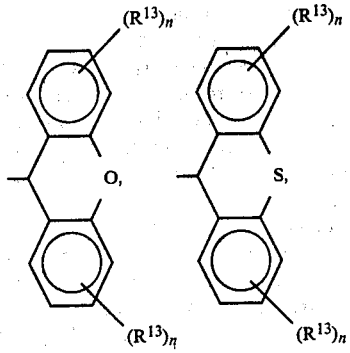

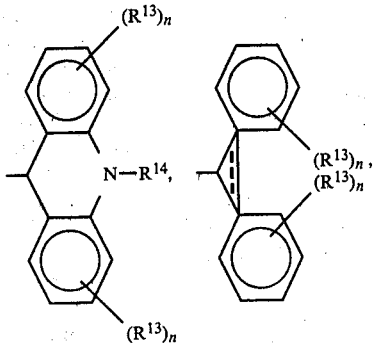

-continued

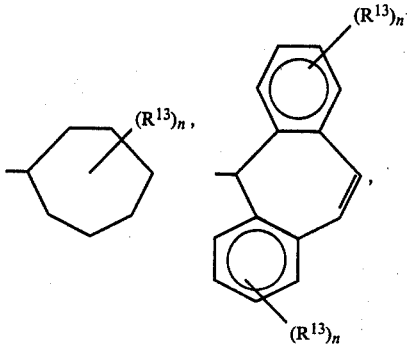

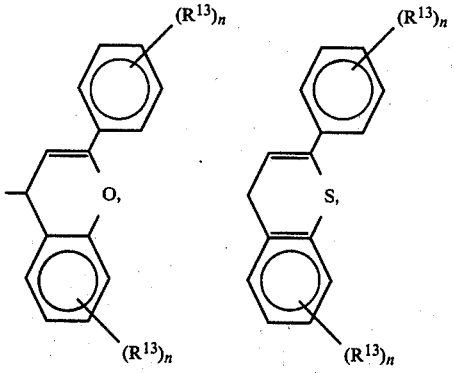

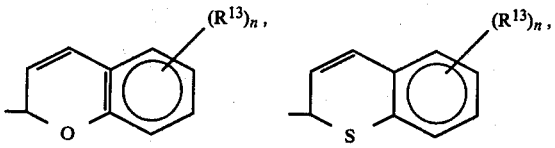

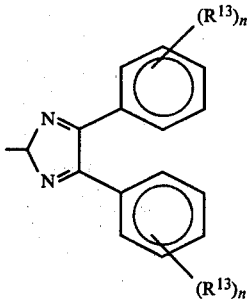

in which $R^{13}$, $R^{14}$ and n are as defined above.

The above naphthol developers must have at least one aromatic group among the $CR^{14}R^{15}R^{16}$ moieties and where there are two hydroxyl groups on either rings of the naphthols they can have two $CR^{14}R^{15}R^{16}$ groups preferably α and γ to the hydroxyl groups. The ring substituent $R^{13}$ can be alkali solubilizing group such as hydroxyl but it is not essential that the naphthol developers of the present invention possess two hydroxyl groups.

Polynuclear hydroquinones and their monoethers which are useful in the practice of this invention correspond to the general formulae:

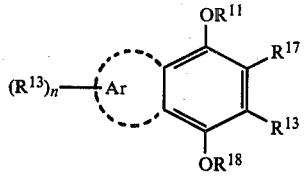

(5)

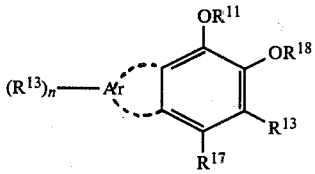

(6)

in which $R^{11}$, $R^{13}$ and n are as defined above, $R^{17}$ represents hydrogen, alkyl, aryl, alkylaryl, alkoxyaryl, hydroxyaryl, aminoaryl, dialkylaminoaryl, and a combination thereof or forms a furan ring with the α-hydroxy group, $R^{18}$ represents hydrogen, alkyl, arylalkyl, alkoxyalkyl, aminoalkyl, quaternary ammonium alkyl or alkyl sulfonate (preferably with up to 20 carbon atoms in each, more preferably with 1 to 8 carbon atoms in the alkyl groups and most preferably with 1 to 3 carbon atoms in the alkyl groups and phenyl for aryl).

The polynuclear Ar group can be any fused aromatic or heterocyclic ring including benzo, naphtho and having the following structures:

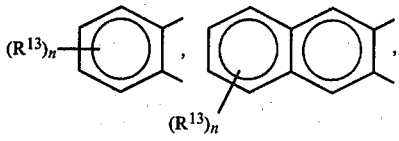

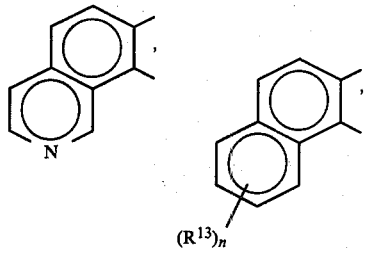

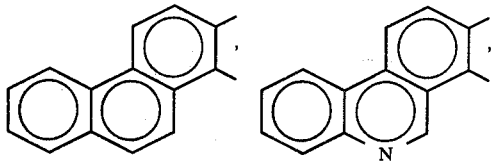

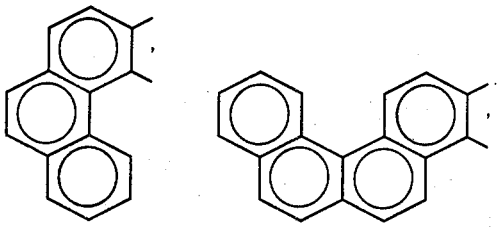

-continued

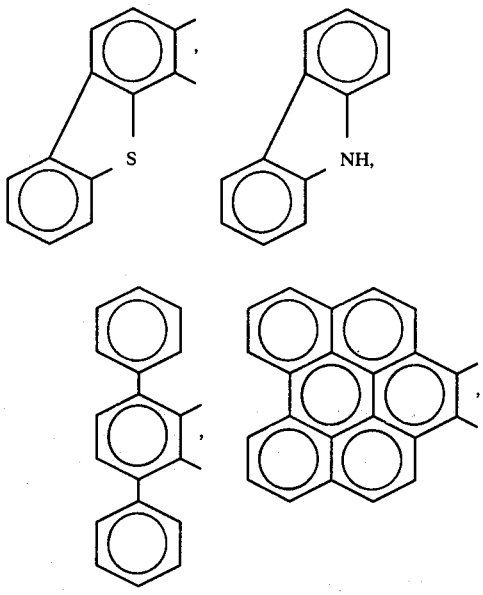

Heterocyclic hydroquinones, naphthohydroquinones and precursors which are useful in the practice of this invention correspond to the following formulae:

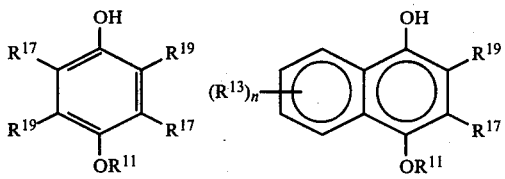

in which $R^{11}$, $R^{13}$, $R^{17}$ and n are as defined above, $R^{19}$ is preferably an aryl group (preferably up to 20 carbon atoms, most preferably phenyl) or together with $R^{17}$ represents the necessary atoms to complete a heterocyclic ring selected from amongst the following structures:

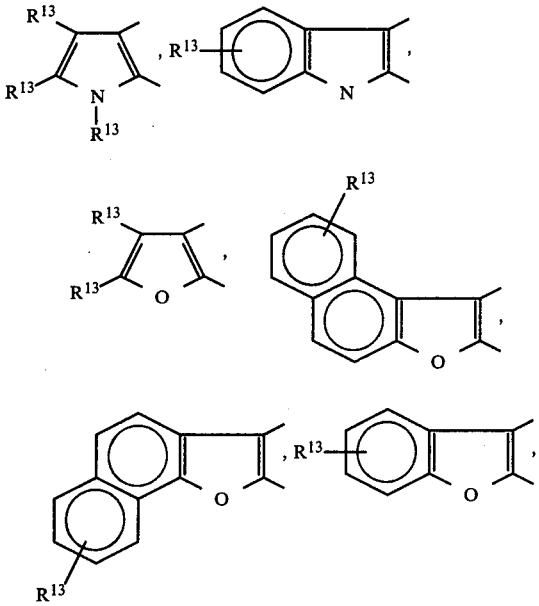

-continued

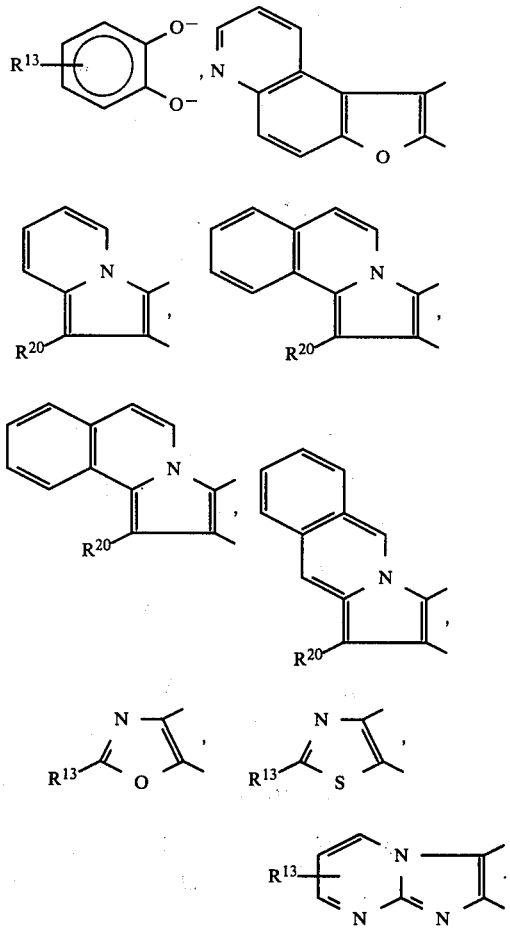

$R^{20}$ represents alkanoyl, aroyl, cyano, aryl or the like.

Bisphenols useful as dye-forming developing agents in this invention correspond to the general formulae:

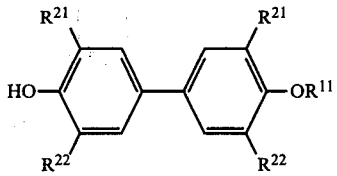

(9)

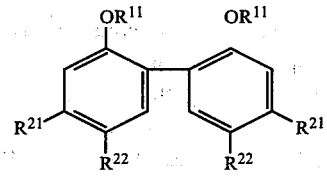

(10)

in which $R^{11}$ is as defined above, $R^{21}$ is alkyl, alkoxy, aryl dialkylamino, $R^{22}$ is alkyl, aryl, alkoxy, dialkylamino or together with $R^{21}$ represents the necessary atoms to form an alicyclic, oxymethylene or aromatic ring.

All alkyl and alkoxy groups, including those on the amines, all preferably 1 to 30 carbon atoms, 1 to 20 carbon atoms, more preferably 1 to 12 carbon atoms and most preferably 1 to 3 carbon atoms. Aryl groups are preferably up to 30 carbon atoms, more preferably up to 15 carbon atoms and most preferably phenyl.

Bis-naphthols useful as dye-forming developing agents of this invention correspond to the following formulae:

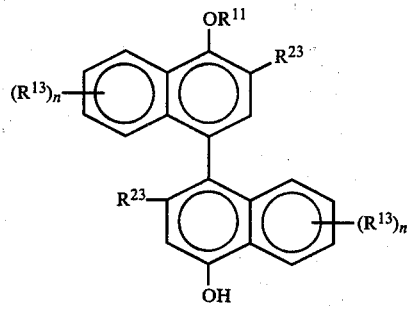

(11)

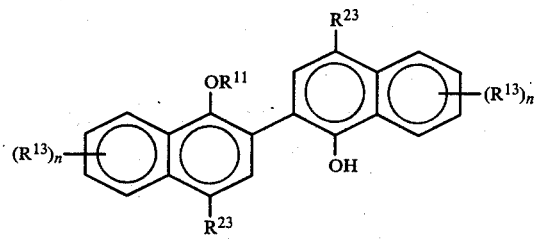

(12)

in which $R^{11}$, $R^{13}$ and n are as defined above, $R^{23}$ represents hydrogen, alkyl, arylalkyl, alkoxy, aryloxy, alkylaryloxy, aryl, alkylaryl, alkoxyaryl, hydroxyaryl, aminoaryl, alkyl and dialkylaminoaryl, carboalkoxy, carboaryloxy, carbonamido, alkylamino, arylamino, diarylamino, N-heterocyclic.

2-Naphthols useful as developing agents of the invention correspond to the following formula:

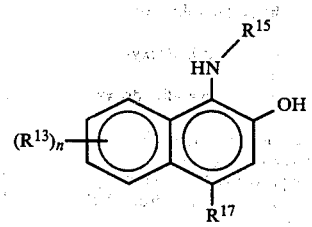

in which $R^{13}$, $R^{15}$, $R^{17}$ and n are as defined above.

Amino naphthohydroquinone developer precursors (keto-1,3-naphthoxazoline), useful in this invention corresponding to the general formula:

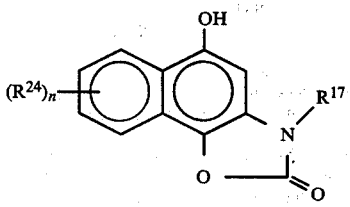

in which $R^{17}$ and n are as defined above, and $R^{24}$ represents hydrogen, alkyl, alkoxy, hydroxy, amino, alkylamino, dialkylamino, N-teterocyclic, aryl or forms a fused aromatic or heterocyclic ring.

The 4-alkoxy-1-naphthols employed in this invention can be prepared according to Japanese patent Specification No. 70/10338 or U.S. Pat. No. 2,572,822 through reduction of 1,4-naphthoquinone in the presence of stannous chloride, phosphoryl chloride and alcohol. 2-Alkoxy-1-naphthols employed in this invention can be prepared by reduction of 1,2-naphthoquinones in a similar fashion as for the 4-alkoxy analogues or according to J. Chem. Soc. (C), 1969, p. 1982, using 1-bromo-2-alkoxynaphthalene or oxidation of 2-alkoxy-naphthalene with lead tetraacetate.

Masked naphthol developers can be prepared by acylation with an acid anhydride or an acid chloride in the presence of an acid acceptor such as triethylamine, pyridine, collidine, N,N-dimethylaniline.

4-Arylmethyl-1-naphthol developers, typically exemplified by 4-benzyl-1-naphthol can be prepared by Friedel Craft alkylation involving α-naphthol, benzyl-bromide and a Lewis acid such as zinc chloride according to J. Chem. Soc. 1952, 4699, J. Chem. Soc. (C), 1966, 926; 1971, 2399, J. Orig. Chem. (1967), 32, 2941.

The naphthofuchsone dyes can be prepared directly via Wittig reaction according to Tetrah. Lett. 1969, 457. The dyes can then be converted to the leuco form with a reducing agent such as sodium borohydride, sodium dithionite or zinc.

Dialkylamino-1-naphthol developers can be prepared from condensation of amino-1-naphthol or its hydrochloride salt with a diketo compound e.g. acetonyl acetone, dehydroacetic acid or chelidonic acid.

Polynuclear hydroquinone developers can be obtained by reduction of their quinone dyes which are prepared by Diels-Alder reaction between an activated vinylaromatic or polynuclear aromatic hydrocarbon with excess benzoquinone according to J. Amer. Chem. Soc. 1949, 71, 3051, J. Chem. Soc. 1957, 366, 4951 and Montash. Chem. (1968), 99, 2032.

Heterocyclic hydroquinone and naphthohydroquinone developers are obtained by reduction of their respective heterocyclic quinone dyes which can be prepared from condensation of 2,3-dichloro-2,4-naphthoquinone or chloranil with phenols, naphthols or activated methylene compounds in the presence of a base such as pyridine, quinoline or triethylamine according to J. Orig. Chem. 1972, 37 (9), 1442; 1963, 28, 520, 1022; 1957, 22, 342; 1954, 19, 176, J. Chem. Soc. 1952, 489, 4699, J. Amer. Chem. Soc. 1957, 79, 1212, 5489.

p-Bisphenols can be prepared from oxidative coupling of phenols according to U.S. Pat. No. 4,097,461.

O-Bisphenols can be prepared from reduction of the corresponding o-diphenoquinone dyes which are obtained by oxidation of phenols with potassium ferricyanide or ferric chloride according to Tetrah. 1978, 1595, J. Chem. Soc. 1962, 4987, 1968, 1434.

Bis-α-naphthol developers can be prepared either by reducing the corresponding dinaphthoquinone dyes with sodium borohydride or by oxidative coupling of 2-alkyl or 2-alkoxy-1-naphthol with ferric chloride.

The following Table 1 reports dye-forming developing agents suitable for use in the present invention and which may be prepared in accordance with the above described methods.

TABLE I

| Compound No. | Nomenclature (structure) | Class | Color (λmax nm) |
|---|---|---|---|
| 1 | 4-ethoxy-l-naphthol | 2 | |
| 2 | 4-propoxy-1-naphthol | 2 | |
| 3 | 4-isopropoxy-1-naphthol | 2 | |

TABLE I-continued

| Compound No. | Nomenclature (structure) | Class | Color (λmax nm) |
|---|---|---|---|
| 4 | 4-butoxy-1-naphthol | 2 | blue |
| 5 | 4(2-chloroethoxy)-1-naphthol | 2 | |
| 6 | 4-(2-methoxyethoxy-1-naphthol | 2 | |
| 7 | 4-cyclohexyloxy-1-naphthol | 2 | |
| 8 | 4-benzyloxy-1-naphthol | 2 | blue |
| 9 | 4-furfuryloxy-1-naphthol | 2 | |
| 10 | 2-bromo-4-methoxy-1-naphthol | 2 | |
| 11 | 2-chloro-4-methoxy-1-naphthol | 2 | |
| 12 | 2,4-dimethoxy-1-naphthol | 2 | |
| 13 | 4-methoxy-5-methoyl-1-naphthol | 2 | |
| 14 | 4-methoxy-8-methyl-1-naphthol | 2 | |
| 15 | 4-methoxy-8-hydroxy-1-naphthol | 2 | |
| 16 | 4,8-dimethoxy-1-naphthol | 2 | |
| 17 | 4-methoxy-7-ethoxy-1-naphthol | 2 | |
| 18 | 4-methoxy-7-methyl-1-naphthol | 2 | |
| 19 | 2-methyl-4-methoxy-7-ethoxy-1-naphthol | 2 | |
| 20 | 5-acetoxy-8-methoxy-1-naphthol | 2 | |
| 21 | 1-acetoxy-4-methoxy-5-acetyl-naphthalene | 2 | |
| 22 | 4-phenoxy-1-naphthol | 2 | |
| 23 | 2-methoxy-1-naphthol | 2 | purple (500) |
| 24 | 4,5-dimethoxy-1-naphthol | 2 | |
| 25 | 4-methoxy-1-anthracenol | 5 | blue |
| 26 | 4-methoxy-9-phenyl-1-anthracenol | 5 | |
| 27 | 4-octyloxy-1-naphthol | 2 | blue |
| 28 | 4-(2-ethoxy)-ethoxy-1-naphthol | 2 | blue |
| 29 | 4-dodecyloxy-1-naphthol | 2 | blue (643) |
| 30 | 4-(2-methacryloyl-oxy)-ethoxy-1-naphthol | 2 | |
| 31 | 2-benzyloxy-1-naphthol | 2 | purple (545) |
| 32 | 2,5-diphenyl-hydroquinone | 7 | |
| 33 | 2,5-dibenzyl-hydroquinone | 7 | yellow |
| 34 | 2,5-di(2,4-dimethylphenyl)-hydroquinnone | 7 | |
| 35 | 2,5-di(2,4,6-trimethyl-phenyl) hydroquinone | 7 | |
| 36 | 2-(4-methylphenyl)-hydroquinone | 7 | |
| 37 | 2-(4-methoxyphenyl)-hydroquinone | 7 | yellow (425) |
| 38 | 2-(2,4-dimethoxyphenyl)-hydroquinone | 7 | yellow (440) |
| 39 | 2-(4-methoxy-phenyl)-5-benzene sulfonyl hydroquinone | 7 | yellow |
| 40 | 2-(2,4-dimethoxyphenyl)-5-benzene-sulfonyl-hydroquinone | 7 | yellow |
| 41 | 2-diphenylamino-5-phenyl-hydroquinone | 7 | purple |
| 42 | 2-(N—ethyl-N—phenyl-amino)-5-phenyl-hydroquinone | 7 | purple |
| 43 | 4-methyl-1-naphthol | 4 | orange-red (504) |
| 44 | 4-cyclohexyl-1-naphthol | 4 | |
| 45 | 4-benzyl-1-naphthol | 4 | |
| 46 | 4-isopropyl-1-naphthol | 4 | |
| 47 | 4-diphenylmethyl-1-naphthol | 4 | yellow (398) |
| 48 | 4-phenyl-1-naphthol | 4 | blue |
| 49 | 2-benzyl-1-naphthol | 4 | red |
| 50 | 2-benzyl-6-methoxy-1-naphthol | 4 | |
| 51 | 2-cyclohexyl-1-naphthol | 4 | red |
| 52 | 2-(4-methylbenzyl)-6-methoxy-1-naphthol | 4 | |
| 53 | 2-(4-methylbenzyl)-1-naphthol | 4 | |
| 54 | 2-t-butyl-1-naphthol | 4 | orange (490) |
| 55 | 2-methyl-1-naphthol | 4 | orange (492) |
| 56 | 4-methyl-1-anthracenol | 4 | |
| 57 | 4-methyl-9-phenyl-1-anthracenol | 4 | |
| 58 | 2-(9-fluorenyl)-1-naphthol | 4 | purple (516) |
| 59 | 2-diphenylmethyl-1-naphthol | 4 | purple |
| 60 | 2-(1-phenylethyl)-1-naphthol | 4 | purple (504) |
| 61 | 2-(4-methoxybenzyl)-1-naphthol | 4 | purple |

TABLE I-continued

| Compound No. | Nomenclature (structure) | Class | Color (λmax nm) |
|---|---|---|---|
| 62 | 3,5,3'-5'-tetramethyl-4,4'-di-hydroxy-[1,1'-biphenyl] | 9 | yellow (420) |
| 63 | 3,5,3',5'-tetraisopropyl-4,4'-di-hydroxy-[1,1'-biphenyl] | 9 | yellow (420) |
| 64 | 3,5,3',5'-tetra-s-butyl-4,4'-di-hydroxy-[1,1'-biphenyl] | 9 | yellow (423) |
| 65 | 3,5,3',5'-tetra-t-butyl-4,4'-di-hydroxy-[1,1'-diphenyl] | 9 | yellow (421) |
| 66 | 3,5,3',5'-tetramethoxy-4,4'-di-hydroxy-[1,1'-biphenyl] | 9 | yellow (460) |
| 67 | 3,5,3',5'-tetraphenyl-4,4'-di-hydroxy-[1,1-biphenyl] | 9 | |
| 68 | 3,3'-dimethoxy-5,5'-di- -styryl-4,4'-dihydroxy-[1,1'-biphenyl] | 9 | purple |
| 69 | 4,5,4'-5'-tetramethyl-2,2'-di-hydroxy-[1,1'-biphenyl] | 10 | |
| 70 | 3,5,3',5'-tetramethyl-2,2'-di-hydroxy-[1,1'-diphenyl] | 10 | |
| 71 | 4,5,4',5'-tetramethoxy-2,2'-di-hydroxy-[1,1'-diphenyl] | 10 | purple |
| 72 | 3,5,3',5'-tetra-t-butyl-2,2'-di-hydroxy-[1,1'-diphenyl] | 10 | |
| 73 | 4,5,4',5'-bis-methylene-dioxy-2,2'-dihydroxy-[1,1'-biphenyl] | 10 | purple (552) |
| 74 | 3,3'-di-t-butyl-5,5'-dimethoxy-2,2'-dihydroxy-[1,1'-biphenyl] | 10 | |
| 75 | 4,4'-di-t-butyl-5,5'-dimethoxy-2'-dihydroxy-[1,1'-biphenyl] | 10 | |
| 76 | 3,4,3',4'-tetramethyl-5,5'-di-methoxy-2,2'-dihydroxy-[1,1'-biphenyl] | 10 | |
| 77 | 1,1'-dihydroxy-2,2'-binaphthyl | 12 | |
| 78 | 1,1'-dihydroxy-4,4'-dimethyl-2,2'-binaphthyl | 12 | purple (554) |
| 79 | 1,1'-dihydroxy-4,4'-dimethoxy-2,2'-binaphthyl | 12 | blue (622) |
| 80 | 1,1'-dihydroxy-4,4'-di(triphenyl-methyl) 2,2' binaphthyl | 12 | blue |
| 81 | 1,1'-dihydroxy-4,4'-di-dodecyloxy-2,2'-binaphthyl | 12 | blue (643) |
| 82 | 4,4'-dihydroxy-1,1'-binaphthyl | 11 | purple |
| 83 | 3,3'-dimethoxy-4,4'-dihydroxy-1,1'-binaphthyl | 11 | purple (545) |
| 84 | 3,3'-di-t-butyl-4,4'-dihydroxy-1,1'-biphenyl | 11 | orange (490) |
| 85 | 3,3'-di(9-fluorenyl)4,4'-dihydroxy-1,1'-biphenyl | 11 | red (516) |
| 86 | 3,3'-di-diphenylmethyl-4,4'-dihydroxy-1,1'-diphenyl | 11 | red |
| 87 | 4,4'-diphydroxy-1,1'-diphenyl | 9 | |
| 88 | 3,3'-dimethoxy-4,4'-dihydroxy-1,1'-biphenyl | 9 | |
| 89 | 4-amino-1-naphthol | 3 | |
| 90 | 1-amino-2-naphthol | 15 | |
| 91 | 4-(2,5-dimethylpyrrolyl)-1-naphthol | 3 | |
| 92 | 4-benzylideneanil-1-naphthol | 3 | |
| 93 | 1,4-bis[4-hydroxy-3,5-di-t-butyl-phenyl]-2,3-dicyano-1,3-butadiene | | red (514) |
| 94 | 3,5,3',5'-tetra-t-butyl-4,4' dihydroxy-stilbene | | yellow (458) |
| 95 | 2,5-di(3-methoxy-4-hydroxyphenyl) furan | | blue |
| 96 | bis(3,5-di-t-butyl-4-hydroxy-benzylidene) azine | | |
| 97 | bis(3-methoxy-4-hydroxybenzylidene) azine | | |
| 98 | 2,6-dimethyl-4-diphenylmethyl-phenol | | yellow |
| 99 | 2,6-di-t-butyl-4-diphenylmethyl-phenol | | yellow |
| 100 | 2,6-di-methoxy-4-diphenylmethyl-phenol | | yellow |
| 101 | 2-benzyl-1,4-dihydroxynaphthalene | 8 | yellow |
| 102 | 2-methoxy-1,4-dihydroxynaphthalene | 8 | yellow |
| 103 | 2-(2,4-dihydroxyphenol)-1,4-dihydroxynapthalene | 8 | |
| 104 | 2(2,4-dimethoxyphenyl)-1,4-dihydroxynaphthalene | 8 | yellow |
| 105 | 3-hydroxyphenothiazine | | purple |

TABLE I-continued

| Compound No. | Nomenclature (structure) | Class | Color (λmax nm) |
|---|---|---|---|
| | | | (535) |
| 106 | 1-phenylamino-2-naphthol | 13 | |
| 107 | 4-phenylamino-1-naphthol | 3 | |
| 108 | 3-phenylamino-1-naphthol | 3 | |
| 109 | 2-methoxy-1-anthracenol | 6 | purple |
| 110 | 2-phenyl-1-naphthol | 4 | purple |
| 111 | 2-phenyl-1,4-dihydroxynaphthalene | 8 | |
| 112 | 2,5-diphenoxyhydroquinone | 7 | |
| 113 | 3,5,3',5'-tetrachloro-4,4'-dihydroxy-1,1'-biphenyl | 9 | |
| 114 | 3,5,3',5'-tetrachloro-4,4'-dihydroxy-1,1'-biphenyl | 9 | |
| 115 | 3-hydroxyphenoxazine | | |
| 116 | 1-trichloroacetoxy-4-methoxy-naphthalene | 2 | Blue (622) |
| 117 | N—[1-(4-hydroxy)naphthyl]-2,5-dimethylpyrrolhydrochloride | 3 | |
| 118 | N—[1-(4-hydroxy)naphthyl]-pyridone-hydrochloride | 3 | |
| 119 | N—[1-(4-hydroxy)naphthyl]-2,6-dimethyl-dihydromorpholine hydrochloride | 3 | |
| 120 | 1-(4-methoxyphenethyl)-1-naphthol | 4 | red (509) |
| 121 | 2-biphenethyl-1-naphthol | 4 | red (503) |
| 122 | 2-[1-(2-naphthyl)ethyl]1-naphthol | 4 | red (506) |
| 123 | 2-benzyl-1,7-dihydroxynaphthalene | 4 | |
| 124 | 2-diphenylmethyl-1,7-dihydroxy-naphthalene | 4 | |
| 125 | 2-(9-dibenzosuberyl)-1-naphthol | 4 | red |
| 126 | 2-(9-dibenzotropyl)-1-naphthol | 4 | |
| 127 | 1,4-dihydroxychrysene | 5 | yellow |
| 128 | 1,4-dihydroxybenzophenanthrene | 5 | |
| 129 | 1,4-dihydroxy-6-methoxy-naphthalene | 5 | |
| 130 | 1,4-dihydroxy-10-methoxy-naphthalene | 5 | |
| 131 | dinaphtho-[2,3,2',3']-furan-8,13-diol | 8 | yellow |
| 132 | 1,1'-dihydroxy-2,2'-dibenzyloxy-4,4'-dinaphthalene | 11 | purple (545) |
| 133 | 2-(4-dimethylaminophenyl)-1,4-dihydroxy naphthalene | 8 | |
| 134 | 1,1'-dihydroxy-2,2'dibenzyl-4,4' dinaphthyl | 11 | red |
| 135 | 2-(2,4,5-trimethoxyphenyl)-1,4-dihydroxynaphthalene | 8 | yellow |
| 136 | 2(-2-hydroxy-4-methoxyphenyl)-1,4-dihydroxynaphthalene | 8 | yellow |
| 137 | 2-[1-(4-hydroxy)naphthyl]-1,4-dihydroxynaphthalene | 8 | yellow |
| 138 | 4-[1-(4-hydroxy)-naphthyl]-1,2-dihydroxynaphthalene | 6 | yellow |
| 139 | 4-(2,4-dimethoxyphenyl)-1,2-dihydroxynaphthalene | 6 | yellow |
| 140 | 4(2,4,5-trimethoxyphenyl)-1,2-dihydroxynaphthalene | 6 | yellow |
| 141 | 4-(p-dimethylaminophenyl)-1,2-dihydroxynaphthalene | 6 | |
| 142 | 1,1'-dihydroxy-2,2'-dimethyl-4,4'-dinaphthyl | 11 | |
| 143 | 1,1-dihydroxy-4,4'di[n-(2,5-dimethyl)-pyrrolyl]-2,2'dinaphthyl | | |
| 144 | 1,1'-dihydroxy-4,4'-di-diethylamino-2,2'-dinaphthyl | | |
| 145 | 1,1'-dihydroxy-4,4'-di[n-2,6-dimethyl)dihydromorpholinyl]-2,2'-dinaphthyl | | |
| 146 | 2-(9-zanthyl)-1-naphthol | 4 | |
| 147 | 1-hydroxy-4-methoxychrysene | 5 | |
| 148 | 4-diethylamino-1-naphthol | 3 | |
| 149 | 2-methyl-1-naphthol | 4 | |

TABLE I-continued

| Compound No. | Nomenclature (structure) | Class | Color (λmax nm) |
|---|---|---|---|
| 150 | 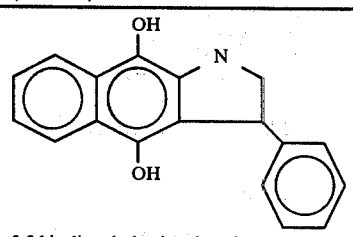 | 8 | |
| 151 | 2,5-bis-dimethylaminophenyl-hydroquinone | 7 | |
| 152 | 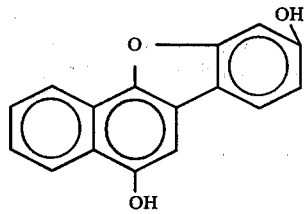 | 2 | |
| 153 | 4-methoxy-1-naphthol | 2 | |

A dispersion of a silver behenate half soap was made at 15% solids in acetone with a "Gaulin" homogenizer. This silver soap dispersion was then prepared for coating by the addition of dilution solvents, halide ion, polymers and sensitizing dyes in a selected sequence of time and mixing as well known in the art. Several different silver soap dispersions and a number of silver coating solutions will be described and they will be used in the following examples to illustrate this invention.

Three different tripacks will be described showing a sequence of six to eight coatings using three monocolor forming systems within each tripack.

EXAMPLE 1

46.72 g of the described silver soap dispersion was diluted with 474.2 g of ethanol. This was followed by the addition of 0.0376 g of polyvinylbutyral dissolved in 6 ml of ethanol. The solution was halidized with 0.0738 g of mercuric bromide dissolved in 18 ml of ethanol. Several hours later, 60 g of polyvinylbutyral was added with mixing.

EXAMPLE 2

90.3 g of the silver soap dispersion was diluted with 440.3 g of ethanol. Then 0.072 g of polyvinylbutyral dissolved in 6 ml of ethanol was added. This solution was halidized with 0.272 g of zinc bromide dissolved in 18 ml of ethanol. 60 g of polyvinylbutyral was added after several hours.

EXAMPLE 3

46.72 g of the silver soap dispersion was diluted with 474.2 g of ethanol. Then 0.0376 g of polyvinylbutyral dissolved in 6 ml of ethanol was added. Halidization was by the addition of 0.099 g of mercuric chloride dissolved in 18 ml of ethanol. 60 g of polyvinylbutyral was then added after several hours.

The first color tripack consisted of six separate coatings all applied at a 3 mil orifice and each dried for 3 minutes at 180° F.

| LAYER | COATING |
|---|---|
| 1 | Blue Sensitive Silver and Yellow CFD (color forming developer) |
| 2 | Barrier Polymer |
| 3 | Green Sensitive Silver |
| 4 | Barrier Polymer and Magenta CFD. |
| 5 | Red Sensitive Silver |
| 6 | Topcoat Polymer and Cyan CFD. |

EXAMPLE 4

The first layer consisted of the blue sensitized silver, yellow-forming developer and developer modifiers.

A mixture of 38 grams of Example 1 silver solution and 226 grams of Example 2 silver solution was made. A separate solution containing the reactants and sensitizing dye was made and added to the mixture upon completion.

7.5 ml acetone
0.15 g 2,6,2',6'-dimethylbiphenol
0.10 g phthalazine
0.035 g phthalic acid
0.025 g tetrachlorophthalic acid dissolved in 1 ml of ethanol
0.0009 g 454 dye in 0.5 ml of methanol The second layer was the yellow/magenta barrier polymer which is the copolymer of vinylidene chloride and acrylonitrile. A solution of this copolymer was prepared by dissolving 10 g of the copolymer in 90 g of acetone.

The third layer was the green sensitive silver. 50 g of the Example 3 silver solution was sensitized with 0.000033 g of 421 dye dissolved in 1.10 ml of methanol.

The fourth layer consisted of the magenta/cyan barrier polymer and the magenta color forming reactants. A polymer premix was prepared by dissolving 60 g of a methylmethacrylate polymer (Acryloid-A21) in 176 g of toluene, 50 g of ethanol, and 14 g of n-butyl alcohol. A reactant premix was prepared with the following in descending order:

10 ml Ethanol
0.96 g Phthalic acid
0.24 g Tetrachlorophthalic acid
0.24 g p-Toluenesulfonic acid
1.20 g Phthalazine
1.20 g Leuco indoaniline magenta dye

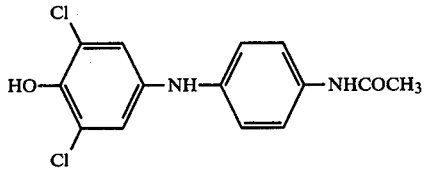

Both solutions were combined and coated.

The fifth layer is the red sensitive silver. 50 g of the Example 1 silver solution was sensitized to the red light by the addition of 0.00005 g of the 563 dye dissolved in 0.2 ml of methanol.

The sixth and last coating consists of the topcoat polymer and the cyan color forming reactants. A polymer premix was prepared by dissolving 20 g of an alcohol soluble cellulose acetate butyrate in 180 g of ethanol.

The developer modifiers were added to this solution in the following descending order:

0.8 g Phthalic acid
0.64 g Tetrachlorophthalic acid
0.24 g p-Toluenesulfonic acid
0.80 g Phthalazine A leuco indoaniline cyan dye premix was made by reducing 0.8 g of

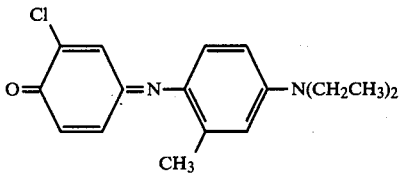

with 0.48 g of ascorbic acid in 40 ml of ethanol. This reduction took 50 to 10 minutes. This solution was added to the polymer topcoat solution after the cyan blue color had turned to a brown color which indicated all of the dye was reduced to the leuco form.

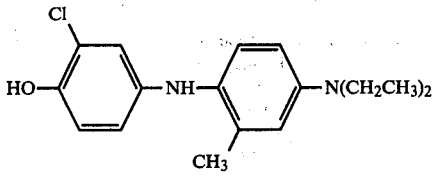

This six layer coated tripack was exposed to tungsten light through a colored negative and processed at 280° F. for 8 seconds. This resulted in a multi-colored positive reproduction (negative acting) of the original colored subject. This same material was exposed to an Eastman Sensitometer Model 101 using narrow band filters at 440, 540 and 620 nanometers separately. The three exposed samples were then processed for 8 seconds at 280° F. The results are shown in the following Table.

| NARROW BAND FILTER (NANOMETERS) | IMAGE COLOR | DMIN | DMAX | GAMMA ANGLE | SENSITIVITY AT 0.75 DENSITY (ERGS) |
|---|---|---|---|---|---|
| 440 | Yellow/ Brown | 0.32 | 1.36 | 21 | 218 |
| 540 | Magenta | 0.27 | 0.76 | 19 | 1585 |
| 620 | Cyan | 0.16 | 0.98 | 31 | 1986 |

EXAMPLE 5

A second color tripack was coated out using a yellow/magenta barrier coating of a butadiene/styrene copolymer (Tyril) and a polyvinyl chloride/acetate/alcohol polymer dissolved in methyl ethyl ketone. This tripack had the same construction as the first one. All of the six solutions were applied at a 3 mil orifice and then dried for 3 minutes at 180° F.

The first layer consisted of the blue sensitive silver, yellow developer and modifiers.

15.05 grams of 15% silver soap dispersion was diluted with 73.4 grams of denatured ethanol and to this was added 0.12 grams polyvinylbutyral dissolved in 0.789 grams of ethanol. This solution was then halidized with 0.0246 grams of mercuric bromide dissolved in 2.37 grams of ethanol. Then 10 grams of polyvinylbutyral was added several hours later.

12.5 grams of the above solution was combined with 12.5 grams of Example 2 solution and 0.5 ml of 0.18 grams of the blue sensitizer 454 dye dissolved in 100 ml of methanol. A solution of 0.15 grams 2,6,2',6'-dimethyl biphenol, 0.13 grams phthalazine, 0.035 grams phthalic acid, and 0.01 grams tetrachlorophthalic acid in 6 ml ethanol was then added to complete the first layer coating solution.

The second layer was dried for 4 minutes at 180° F. This was the yellow/magenta barrier layer which consisted of 15 grams butadiene-styrene copolymer and 5 grams of a polyvinyl (chloride-acetate-alcohol) tripolymer (VAGH) dissolved in 80 grams methyl ethyl ketone.

50 grams of a silver half soap of a fatty acid containing 70% behenic acid was dispersed by ballmilling for 24 hours in 413 ml ethanol and 52 ml toluene. 21.97 g of this silver soap dispersion in Example 12 was diluted with 66.48 g of ethanol and to this was added 0.12 g of polyvinylbutyral dissolved in 0.789 g of denatured ethanol. This solution was then halidized by the addition of 0.0246 g of mercuric bromide dissolved in 2.37 g of ethanol. Then 10 g of polyvinylbutyral was added several hours later.

The third layer was the magenta silver layer.

25 g of the halidized silver solution of the previous layers was sensitized to the green with the addition of 0.1 ml of 0.033 g 421 dye dissolved in 100 ml of ethanol.

The fourth layer is the magenta/cyan barrier which contains the magenta developer and modifiers. A solution of a 10% methylmethacrylate polymer was prepared by dissolving 2.5 g of the polymer in 20.25 g of toluene, 1.67 g of ethanol, and 0.58 g of n-butyl alcohol. A reactant premix was prepared by dissolving 0.1 g phthalic acid, 0.5 g p-toluenesolfonic acid, 0.05 g tetrachlorophthalic acid, 0.10 g phthalazine, and 0.10 g of the leuco indoaniline magenta dye (see Example 5) in 2.5 ml ethanol.

The fifth layer contains the red sensitive silver salt for the cyan image.

25 g of the halidized silver solution used in the previous layers was sensitized to the red with the addition of 0.2 ml of 0.020 g 563 dye dissolved in 100 ml of methanol.

The sixth and final layer is the topcoat which here contains the cyan developer and modifiers. A polymer premix was made by dissolving 10 g of an alcohol soluble cellulose acetate butyrate in 90 g of ethanol. Then 0.6 g phthalic acid, 0.30 g p-toluenesulfonic acid, 0.32 g tetrachlorophthalic acid, and 0.28 g of phthalazine were added and dissolved.

A leuco indoaniline cyan premix was prepared by dissolving 0.40 g of the indoaniline dye,

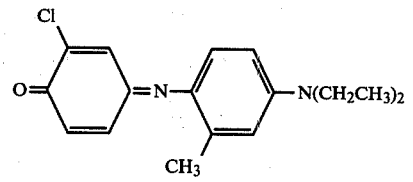

in 20 ml of ethanol and then adding 0.24 g of ascorbic acid to reduce the dye to its leuco form.

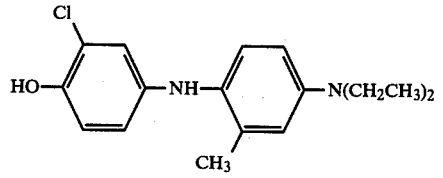

When this solution went from a dark blue color to a light brown color, it was added to the polymer premix containing the developer modifiers and stabilizers.

This material was exposed to 4"×5" color negative enlargements on an Omega Enlarger for 25 to 100 seconds depending on the negative. The exposed samples were then processed for 8 seconds at 280° F. A multicolored positive reproduction was produced for each negative with very good color separation.

EXAMPLE 6

A third color tripack was prepared using a monoethyl ester of poly(methylvinyl ether/maleic acid) for the yellow/magenta barrier layer. The yellow developer consisting of two different compounds was placed in this layer with their modifiers. A silver full soap was used in the yellow color forming layer. The cyan color forming layer used a combination of two developers also which were located in the last layer. Two additional barrier layers were also used to bring the number up to eight separate layers. The following format was used to produce this tripack.

| COATED LAYER | ORIFICE (Mils) | DRYING TIME (Min. @ 170° F.) |
|---|---|---|
| 1. Blue Sens. Silver | 3 | 5 |
| 2. Yellow Dev. & Barrier Polymer | 3 | 6 |
| 3. Barrier Polymer | 2 | 5 |
| 4. Green Sens. Silver | 3 | 6 |
| 5. Magenta Dev. & Barrier Polymer | 3 | 6 |
| 6. Barrier Polymer | 2 | 5 |
| 7. Red Sens. Silver | 3 | 4 |
| 8. Cyan Dev. & Topcoat Polymer | 3 | 3 |

A silver full soap homogenate for the yellow color forming layer was prepared by dispersing 240 g of a silver full soap of a fatty acid containing 90% behenic acid in a solution of 3 g of polyvinylbutyral in 347 ml of toluene and 3113 ml of ethanol. This was homogenized at 8000 psi; cooled to 20° F. or less; and then rehomogenized at 4000 psi.

The first layer coating was prepared by diluting 185.7 g of the homogenate of this Example with 221 ml of ethanol. This was then halidized with 0.0252 g of mercuric bromide and 0.305 g of zinc bromide dissolved in 8.8 ml of ethanol. 48 g of polyvinylbutyral was added after several hours. The addition of 0.0029 g of the 454 dye dissolved in 1.6 ml of methanol sensitized the solution to blue light.

The second layer consisted of the yellow/magenta barrier polymer, the yellow developer and development modifiers.

90.78 g Ethanol
25.0 g Monoethyl ester of poly(methylvinylether/-maleic acid)
0.3 g 2,6,2',6'-dimethylbiphenol
0.3 g 2-(3,5-ditert-butyl-4-hydroxy phenyl) phenanthrene-9,10-imidazole

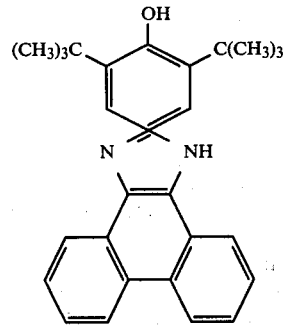

1.0 g phthalazine
0.2 g phthalic acid
0.1 g 4-methylphthalic acid

The third layer consisted of 25 g of the monethyl ester of poly(methylvinylether/maleic acid) dissolved in 75 g of ethanol.

The fourth layer to be applied was the green sensitized silver. 136.8 g of the silver soap dispersion in Example 5 was diluted with 192 g of toluene, 0.7 ml n-methylpyrrolidone and 3 ml of 5 g of polyvinylbutyral dissolved in 100 ml of ethanol. This was halidized with 0.0252 g of mercuric bromide and 0.0252 g of mercuric bromide and 0.2574 g of calcium bromide dissolved in 12 ml of ethanol. Then 27 g of polyvinylbutyral and 8 ml of 4 g of mercuric acetate dissolved in 100 ml of methanol were added to finish the solution.

25 g of this solution was sensitized to the green by the addition of 0.2 ml of 0.10 g of erythrosin dissolved in 100 ml of ethanol.

The fifth layer consisted of the magenta/cyan barrier polymer and the magenta reactants. A polymer premix was prepared by dissolving 64.5 g of a methylmethacrylate polymer in 178.5 g of toluene and 15.05 g of n-butyl alcohol. The leuco indoaniline magenta developer was prepared by reducing the dye with ascorbic acid. This was done by dissolving 0.63 g of ascorbic acid in 45 g of ethanol. Then 1.2 g of the magenta indoaniline dye was added.

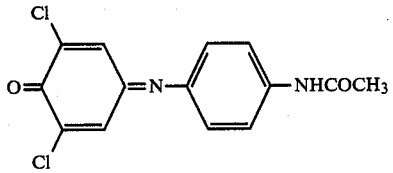

The dye was reduced by the ascorbic acid after 10 to 15 minutes and this was established by the color change from a dark magenta to a light brown. 0.6 g of p-toluene sulfonic acid was then added plus the following in descending order:

1.2 g Phthalic acid
0.6 g Tetrachlorophthalic acid
1.2 g Phthalazine

When all reactants were dissolved, the solution was added to the polymer premix.

The sixth layer consisted of 20 g of a methylmethacrylate polymer dissolved in 75.33 g of toluene and 4.7 g of n-butyl alcohol.

The seventh layer contained the red sensitive silver. This was prepared from a homogenized silver half soap of a fatty acid (70% behenic acid) in a 90% toluene/10% ethanol solvent system. 300 g of the silver half soap was homogenized as described in this example in 2696 ml of ethanol and 247 ml of toluene.

273.6 g of this homogenate was diluted with 397 ml ethanol, 60 ml of toluene and 1.4 ml N-methylpyrrolidone. Then 0.09 g of polyvinylbutyral dissolved in 1.8 ml of ethanol was added. The solution was halidized with 0.0334 g of mercuric bromide and 0.343 g of calcium bromide in 27.9 ml of ethanol. The solution was finalized by the addition of 54 g of polyvinylbutyral and a solution 0.384 g of mercuric acetate dissolved in 9.6 ml of methanol.

The solution was red light sensitized by the addition of 0.7 ml of 0.013 g of 563 dye dissolved in 25 ml of methanol to 30 g of the finished silver solution.

The eighth and final topcoat layer consisted of a polymer and the cyan color forming reactants. A polymer premix was prepared by dissolving 60 g of an alcohol soluble cellulose acetate butyrate in 684 ml of ethanol. The developer modifiers, stabilizers and one of the developers were added in descending order:

2.16 g p-Toluenesulfonic acid
1.32 g Tetrachlorophthalic acid
2.40 g Phthalic acid
2.40 g Phthalazine
2.40 g 4-methoxy-1-hydroxy-naphthalene The other developer was the leuco indoaniline dye

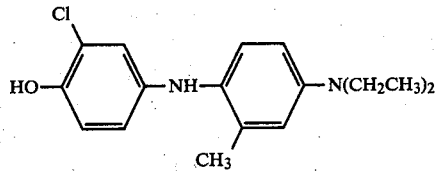

prepared from the reduction of the dye with ascorbic acid in alcohol. 0.72 g of the indoaniline dye

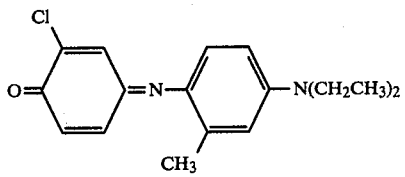

was dissolved in 36 ml of ethanol and 0.432 g of ascorbic acid was added. This solution was added to the polymer premix solution after the color change from blue to brown.

The coated tripack was exposed to a multicolored negative image and then processed for 10 seconds at 255° F., to give a positive multicolored reproduction of that image.

Then three separate samples were exposed for $1\times10^{-3}$ seconds to a filtered xenon flash light source. A sample was exposed to a narrow bandpass blue filter with a peak at 450 nanometers. Another one was exposed to a green filter with a peak at 540 nanometers and the third one was exposed to a red filter with a peak at 610 nanometers. A continuous density wedge was used in each case and all were processed for 10 seconds at 255° F. The results were as follows:

| BANDPASS FILTER PEAK (NANOMETERS) | IMAGE COLOR | DMIN | DMAX | GAMMA ANGLE | SENSITIVITY 0.6 DENSITY ABOVE FOG (ERGS) |
|---|---|---|---|---|---|
| 450 | Yellow/Brown | .46 | 1.54 | 61° | 10 |
| 540 | Magenta | .20 | 1.57 | 46° | 33 |
| 610 | Cyan | .12 | 1.60 | 49° | 650 |

The use of methylmethacrylate polymers as barrier resins are limited. Two of the preferred polymers are Rohm Haas's Acryloid A21 and B66. The Acryloid B44 and B84 polymers, when used alone, failed as barrier polymers. The latter two are methyl methacrylate copolymers which are useful soft resins as additives to other barrier polymers. Acryloid A21 is not a copolymer.

Bipack or two color systems can also be made using this barrier polymer technology. This can be accomplished by several methods. The color forming systems can be interchanged within the different polymer systems to form bipacks. The bipacks will require a minimum of four layers. The bipack polymer systems could be of two different matrixes.

| LAYER | POLYMER MATRIX I | POLYMER MATRIX II |
|---|---|---|
| 1 | Polyvinylbutyral | Polyvinylbutyral |
| 2 | Polyvinylidiene Chloride | Methyl Methacrylate |
| 3 | Polyvinylbutyral & Alcohol | Polyvinylbutyral & Alcohol |
| 4 | Cellulose Acetate Butyrate & Alcohol | Cellulose Acetate Butyrate & Alcohol |

Three bipacks which could be produced are the yellow magenta, the yellow/cyan and the magenta/cyan. The silver sensitivities could be blue/green, blue/red and green/red bringing the possible bipack combinations up to nine.

Simultaneous coatings of the individual monocolor systems can be accomplished by using similar solvents in both silver and polymer topcoat systems. The incorporation of fluorocarbon surfactants, such as the 3M FC431, into one or both layers improves this coating technique. The coatings can be applied by a number of different methods known by prior art.

SENSITIZING DYES USED IN EXAMPLES

454

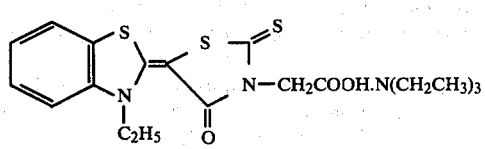

421

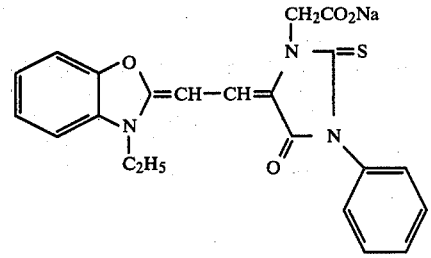

ERYTHROSIN

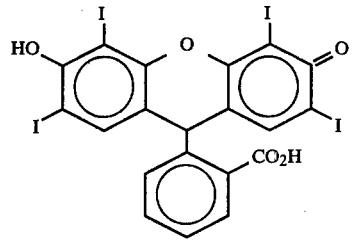

-continued

SENSITIZING DYES USED IN EXAMPLES

563

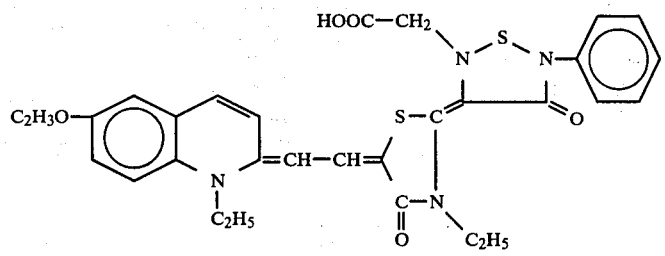

I claim:

1. A color photothermographic imageable article comprising a substrate, a photothermographic emulsion layer, an organic solvent soluble barrier layer, a second photothermographic emulsion layer and a polymeric cover layer, wherein each of the photothermographic layers comprise a reducible silver source, photosensitive silver halide, a reducing agent for silver ion and solvent soluble binder, and further wherein each photothermographic layer is sensitized to a portion of the spectrum at least 60 nm different from the other photothermographic layer, and each photothermographic layer contains a leuco dye which when oxidized forms a feasible dye having a maximum absorbance at least 60 nm different from that of the dye formed in the at least one other photosensitive layer, and the barrier layer is between said photothermographic layers and is impermeable to the solvent contained in the second photothermographic layer.

2. The article of claim 1 wherein said barrier layer comprises an acrylic polymeric material.

3. The article of claim 2 wherein said barrier layer comprises a methylmethacrylate polymeric material.

4. The article of claim 1 wherein a third photothermographic emulsion layer is present in said article, said third photothermographic emulsion layer comprising a reducible silver source, photosensitive silver halide, a reducing agent for silver ion and solvent soluble binder, and where said third photothermographic layer is sensitized to a portion of the spectrum which is at least 150 nm different from at least one of said first two photothermographic layers, and is no nearer than at least 60 nm to either of said two photothermographic layers and contains a leuco dye which, when oxidized, forms a dye having a maximum absorbance which is at least 60 nm different from both of the dyes formed in said first two photothermographic layers and at least 150 nm different from at leaast one of said dyes formed in said first two photothermographic layers.

5. The article of claim 4 wherein a second organic solvent soluble barrier layer is present in said article between said third photothermographic layer and the nearest one of the two first photothermographic layers.

6. The article of claim 5 wherein said second barrier layer is an acrylic polymeric material.

7. The article of claim 6 wherein said second barrier layer comprises a methylmethacrylic polymeric material.

8. The article of claim 1 wherein the binder for at least one of said photothermographic layers comprises polyvinyl butyral.

9. The article of claim 2 wherein the binder for said first and second photothermographic layers comprises polyvinyl butyral.

10. The article of claim 4 wherein the binder for at least one of said photothermographic layers comprises polyvinyl butyral.

11. The article of claim 4 wherein the binder for at least two of said photothermographic layers comprises polyvinyl butyral.

12. The article of claim 1 wherein at least one of the photothermographic layers further comprises a toner.

13. The article of claim 4 wherein at least one of the photothermographic layers further comprises a toner.

14. The article of claim 13 wherein said toner comprises phthalizine in combination with an acid selected from the group consisting of (a) phthalic acid and (b) derivatives of phthalic acid.

15. The article of claim 5 wherein the second organic solvent soluble barrier layer comprises a polymer selected from the group consisting of maleic anhydride copolymers, polyvinylidene chloride polymers or copolymers, and polyvinylpyrrolidone.

16. The article of claim 5 wherein the six layer construction of a three color producing matrix-shall comprise a first barrier which is impermeable to toluene or acetone and the second barrier which is impermeable to at least one of methyl alcohol, ethyl alcohol, isopropyl alsochol or butyl alcohol.

* * * * *

UNITED STATES PATENT AND TRADEMARK OFFICE

CERTIFICATE OF CORRECTION

PATENT NO. : 4,460,681

DATED : July 17, 1984

INVENTOR(S) : Robert A. Frenchik

It is certified that error appears in the above-identified patent and that said Letters Patent is hereby corrected as shown below:

Col. 14, line 3 should begin a new paragraph.

Col. 15, line 35 "hydroquinnone" should read --hydroquinone--.

Col. 27, line 30 "feasible" should read --visible--.

Col. 28, line 50 "matrix-shall" should read --matrix shall--.

Signed and Sealed this

*Second* Day of *July 1985*

[SEAL]

*Attest:*

DONALD J. QUIGG

*Attesting Officer* *Acting Commissioner of Patents and Trademarks*